US006305094B1

(12) United States Patent
Wolf

(10) Patent No.: US 6,305,094 B1
(45) Date of Patent: Oct. 23, 2001

(54) APPARATUS FOR DETECTING INDICIA

(76) Inventor: Bernd Wolf, Bonhoefferstrasse 10, 69123, Heidelberg (DE)

( * ) Notice: Subject to any disclaimer, the term of this patent is extended or adjusted under 35 U.S.C. 154(b) by 0 days.

(21) Appl. No.: 09/206,853

(22) Filed: Dec. 8, 1998

(30) Foreign Application Priority Data

Dec. 8, 1997 (DE) ..... 197 54 325

(51) Int. Cl.[7] ..... G01B 3/14

(52) U.S. Cl. ..... 33/562; 33/563; 33/1 SB; 33/1 SD

(58) Field of Search ..... 33/1 SB, 1 SD, 33/562, 563

(56) References Cited

U.S. PATENT DOCUMENTS

| | | | | |
|---|---|---|---|---|
| 848,399 | * | 3/1907 | Rowell | 33/474 |
| 1,781,047 | * | 11/1930 | Bondeson | 434/354 |
| 2,525,837 | * | 10/1950 | Simplair | 33/563 |
| 3,089,260 | * | 5/1963 | Gray | 434/364 |
| 3,705,294 | * | 12/1972 | Kuehnle et al. | 235/487 |
| 4,021,938 | * | 5/1977 | Antioco | 434/354 |
| 4,262,422 | * | 4/1981 | Pass | 33/41.2 |
| 4,586,906 | * | 5/1986 | Buccieri, Jr. | 434/364 |
| 4,603,884 | * | 8/1986 | Burton | 283/115 |
| 4,713,891 | * | 12/1987 | Cayton | 33/1 G |
| 4,852,268 | * | 8/1989 | Sutherland et al. | 33/562 |
| 4,916,827 | * | 4/1990 | Rayburn | 33/563 |
| 5,007,642 | * | 4/1991 | Henry et al. | 273/148 R |
| 5,133,554 | * | 7/1992 | Piccinini Sr. | 273/148 R |
| 5,154,422 | * | 10/1992 | Highsmith, Sr. et al. | 273/148 R |
| 5,412,874 | * | 5/1995 | Madden | 33/1 SB |
| 5,893,797 | * | 4/1999 | Marino et al. | 463/46 |

FOREIGN PATENT DOCUMENTS

| | | | |
|---|---|---|---|
| 2625694 | * | 12/1977 | (DE) . |
| 89 13 848.1 | | 3/1990 | (DE) . |
| 296 16 813 | | 1/1997 | (DE) . |
| 000446696A1 | * | 9/1991 | (EP) . |
| 2596999 | | 10/1987 | (FR) . |

* cited by examiner

*Primary Examiner*—Diego Gutierrez
*Assistant Examiner*—Lydia M. DeJesús
(74) *Attorney, Agent, or Firm*—Gabriel P. Katona L.L.P.

(57) ABSTRACT

Apparatus for detecting indicia on a document, such as a lottery ticket, which is a flat template having two side edges that are parallel to each other, one of the edges also serving as a guide for the document that has indicia thereon to be detected and processed, the guide member disposed along one of the side edges serves to position and guide the document on the template, a substantially L-shaped cutout in the template and having a first leg and a second leg for placement of the cutout over a plurality of indicia disposed in a line on the document, a plurality indicator elements disposed substantially equidistantly from each other each and extending into the cutout, a plurality of number fields each associated with an indicator element, each indicator element or number field being associated with specific indicia on the document.

4 Claims, 1 Drawing Sheet

APPARATUS FOR DETECTING INDICIA

FIELD OF INVENTION

The invention relates to an apparatus for detecting indicia.

BACKGROUND

An apparatus for marking indicia is known from German patent No. 89 13 848 U1, which is configured as a template. The template has a flat surface and at least two edges that run parallel to each other. At least one edge serves as a guide for a document that is to be detected or processed. The template has elongated cutouts with filler pieces that can be punched out. The cutout can be placed over a variety of symbols that are arranged in a row. Each cutout is aligned with a specific symbol or is associated with it.

Another apparatus is known from German patent No. 296 16 813 U1 to detect indicia. This apparatus is configured as a template and has a flat surface in which there are cutouts with pre-punched numbered boxes. The cutouts can be placed over a variety of symbols that are arranged in a row, whereby each indicator element or field is aligned with a specific symbol or is associated with it.

Another apparatus for detecting indicia is known from French patent No. 2 596 999 A1. This apparatus is likewise configured as a template and has side edges that run parallel to each other. The side edge serves as a guide for a document that is to be detected or processed.

SUMMARY OF THE INVENTION

The present invention has as one objective to configure a template so that symbols or winning numbers on a lottery ticket can be made to appear in a simple manner such as to compare these indicia with the winning numbers of a lottery drawing.

This objective is achieved according to the present invention by an apparatus for detecting indicia, having a flat template with two side edges that are parallel to each other, at least one of the edges being adapted to be a guide for a document having indicia thereon to be detected and processed, a guide member disposed along a side edge for the positioning and guiding of a document on the template, an L-shaped cutout having a first leg and a second leg in the template for placement of the cutout over a plurality of indicia disposed in a line on the document, a plurality indicator elements disposed substantially equidistantly from each other each extending into the cutout, a plurality of number fields each associated with an indicator element, each indicator element or number field being associated with a specific symbol on the document.

Due to the suitable configuration of the apparatus or template, it can be slid along a lottery ticket or other document. Each time it reveals the numbers or indicia that are arranged in a row and that are to be compared to the desired numbers, such as those of a lottery drawing. The other numbers of the other lotteries or series that are not involved remain covered. For this purpose, the cutout is L-shaped. Due to the configuration of the cutout the numbering of the events can be made to appear in the L-shaped area of the cutout so that all of the pertinent indicia such as the winning numbers can be checked one at a time in the desired order.

Advantageously one leg of the cutout extends perpendicularly to the side edges of the template and the second leg of the cutout runs parallel to the side edges of the template.

In another embodiment of the present invention, the length of the second leg suitably corresponds approximately to the total height of two or more rows of indicia arranged one below the other on the document or lottery ticket to be read.

An especially significant feature of the present invention is that together with a delineation edge of the cutout, one lower edge of the indicator element forms a free space in which symbols or indicia arranged in a first row on the document can be detected and a second row of indicia that is arranged above the first row of indicia is covered by the indicator elements when the first row of symbols is visible in the free space.

Detecting the individual winning numbers is facilitated by the indicator elements being tapered towards the front and in that the indicator elements are shaped like truncated cones.

In the design and configuration of the apparatus of the present invention, a plurality of indicator elements are suitably arranged next to each other and the respective surface areas of each are of substantially equal size, with a blank writing field being located above each indicator element.

Since there is a blank writing field provided above each indicator element that is aligned with a selected number on the document below the template, the winning number drawn can be entered into this blank writing field so that, for example, in the case of lottery drawings, six winning numbers as well as an extra bonus number can be entered in the writing field above the indicator elements and the drawn winning numbers that are entered in the writing field can be compared to the numbers of the indicia below that have been selected by the player. In this manner, it is easy to compare the current winning numbers with the numbers selected by the player. Such an apparatus is especially well-suited for lottery tickets on which several drawings are printed out one below the other. The winning numbers can be entered in the free field above the indicator elements, while below the indicator elements, the numbers selected or entered by the individual player can be made visible.

Advantageously a guide element is provided on one side edge of the template and, an open space is formed by a tab, and the document can be inserted into the open space items formed and slid therein. The template can also have another guide element on the other side edge. These guide elements ensure an exact positioning of the template over the lottery ticket.

Since the lottery tickets have a standard size, it is sufficient according to the present invention that only one side edge be provided with a guide for sliding the template relative to the lottery ticket. If the size of the lottery ticket can vary, however, the guide element could also be slid correspondingly on the template so that the game selections can always be made visible precisely in the cutout of the template.

BRIEF DESCRIPTION OF THE DRAWING

Further advantages and details of the present invention are disclosed in the following detailed description with reference being had to the drawing, wherein.

DETAILED DESCRIPTION

Figure 1:
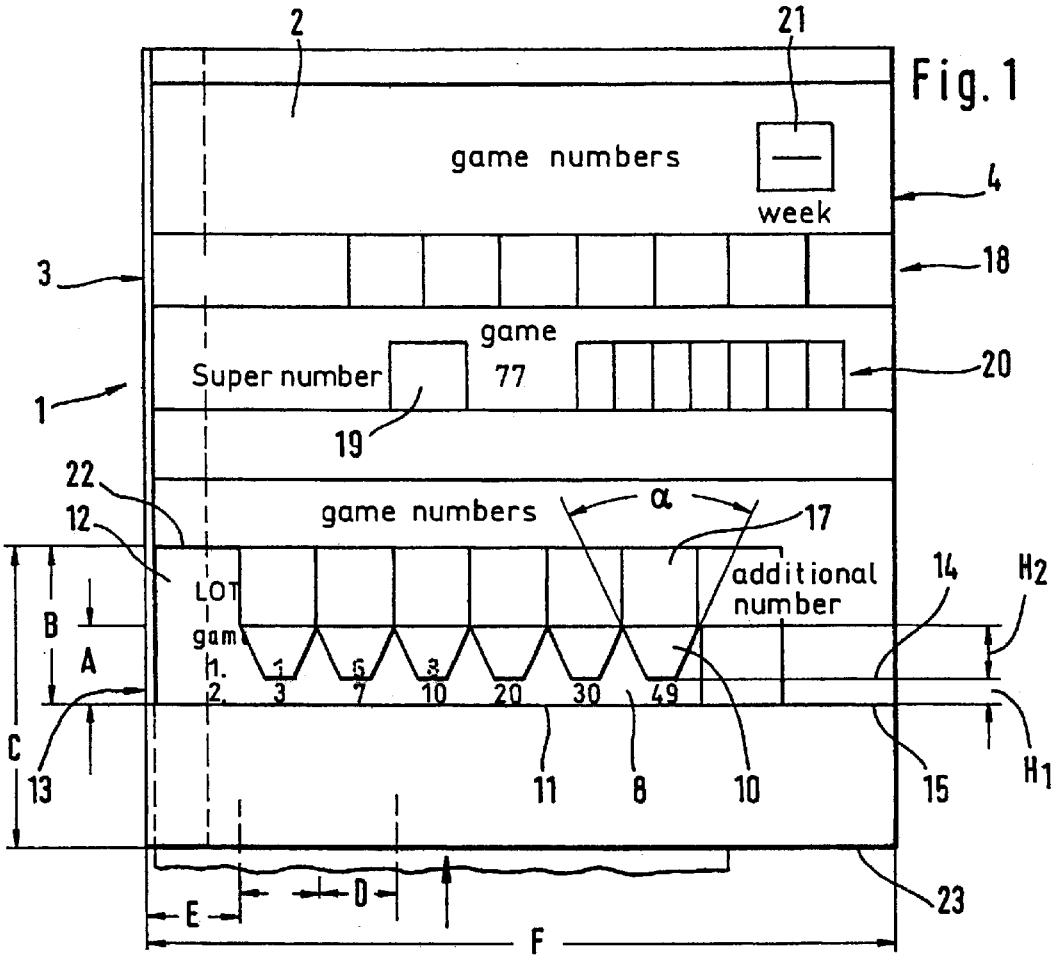
FIG. 1 is a top view of the template of the apparatus.

The apparatus 1 is a flat template in the described embodiment of the invention, for detecting any kind of symbols, numbers or drawing selections. The template 1 is of a flat, firm cardboard or of a sheet of plastic and the like with a flat surface.

There are a number of fields 18 on the surface 2 of the template 1, whereby a field 18 has suitably seven headings in which the numbers, such as that of the current drawing can be entered. A field 19 can serve to receive the super number and a field 20 can serve to receive the drawing or game numbers from e.g. or Drawing Game 77. Moreover, it is possible to provide another field 21 such as is shown in the upper right part in which e.g. the game week number can be entered. After the drawing has been held, the winning numbers can be entered in numerical order in a number field 17. The number field 17 has in the illustrated embodiment seven headings in which the six winning numbers as well as the extra bonus number can be entered in numerical order.

The surface 2 of the template 1 can be made of a material such as plastic or even cardboard which makes it possible to erase the winning numbers again after a document such as a lottery ticket 5 has been checked.

There are a plurality of indicator elements 10 located below the number field 17. Each indicator element 10 is associated with a specific heading or rectangular box. It is also possible to associate a number field 17 or a heading with each number or each indicia and to dispense with the indicator element 10. In this manner, the numbers of the draw or game selection can be more easily detected or recognized by the user.

The six indicator elements 10 in this embodiment are each frustoconically shaped and are tapered downwardly with respect to the lottery ticket 5. One lower edge 14 of the indicator element 10 extends into a substantially L-shaped cutout 8 which has a leg 11 and a leg 12.

The leg 12 runs parallel to a left side edge 3 and to a right side edge 4 of the template 1. The two side edges 3 and 4 likewise extend in the lengthwise direction of the template 1.

The lower edge 14 of each indicator element 10—together with a delineation edge 15—forms a free space in which six drawing numbers arranged next to each other can be made to appear. The sequential individual drawing numbers can be made to appear in the leg 12 of the cutout 8. The height of the leg 11 of the substantially L-shaped cutout 8 is indicated by the dimension A and is comprised of the heights $H_1$ and $H_2$. The dimension A corresponds to the heights $H_2+H_1$, and refers to the height of the leg 11 of the cutout 8. The dimension B is the height of the leg 12 extending in the lengthwise direction of the template.

An upper edge or delineation line 22 of the number field 17 is located at a distance C from a lower edge 23 of the template 1. The length C corresponds to about one-third of the total length of the template 1.

Figure 2A:
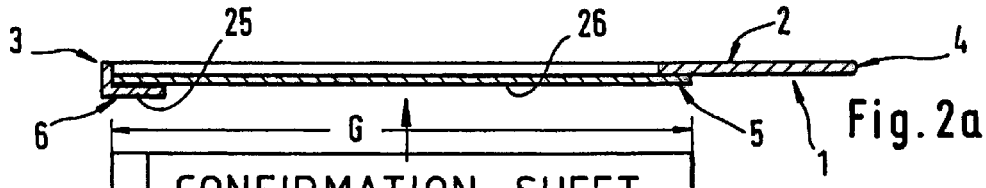
FIG. 2 is a cross-sectional view of the template together with a lottery ticket of a German state lottery, which can be slid along underneath the template for the detection of indicia thereon.
Figure 2B:
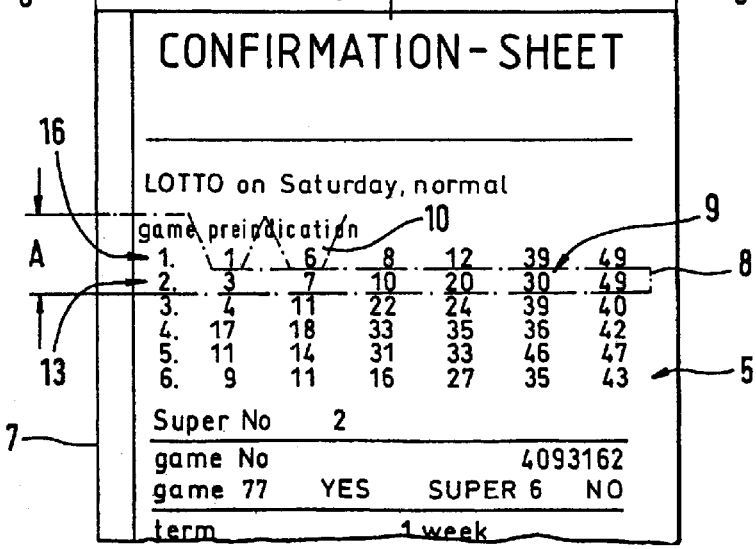

The template 1 has a width F which, as can be seen in comparison with FIG. 2, is somewhat greater than the total width of a lottery ticket.

As can be seen in FIGS. 1 and 2, the first indicator element 10 is at a distance E from the left side edge 3, the distance E corresponding to the width of the leg 12 of the cutout 8.

As can be seen from the cross-sectional view of the template 1 in FIG. 2, on the left side of the template 1, there is a guiding element 6 of a U-shaped tab 25 that grasps about the bottom 26 of a document or lottery ticket 5 so that the document 5 is guided by and can be slid along the tab 25.

The tab 25 can be joined to the template 1 as a single piece. However, it is also possible for the guide 6 to be configured as a positioning element and to be detachably connected to the bottom, so that the guide element 6 on the template can be adjusted to the left or right as seen in FIG. 2, depending on the width of the lottery ticket 5 or on the amount by which the distance E between the left side edge 3 and the first indicator element 10 changes.

According to FIG. 1, the sidewalls of the part of the indicator element 10 that is shaped like a truncated cone can enclose an angle between 20° and 60°.

Advantageously the width G of the document or lottery ticket 5 is of the same size as the printed lottery draw selections in the center of the lottery ticket. If the entire block of lottery selections is shifted to the left or to the right, then the corresponding cutout 8 of the template 1 can be shifted to the left or to the right, whereby the stop or guide element 6 provided on the template can be correspondingly adjusted.

I claim:

1. A lottery template which comprises, (a) a top surface, (b) edge control means for retaining and orienting a lottery ticket below said top surface, (c) cutout means in said top surface for presenting indicia theretrough from a lottery ticket when a ticket with indicia thereon is disposed below the template, (d) a plurality of blank space means on said top surface, each of said blank space means being provided for the entry of drawn lottery numbers therein, said blank space means being disposed horizontally with respect to each other and adjacent to said cutout means, and (e) a plurality of indicator means each with a pointer portion, each of said indicator means being associated with a blank space means and each of said pointer portions pointing from one of said said blank space means toward a part of said cutout means for associating a blank space means with respective indicia on a lottery ticket under the template.

2. The lottery template of claim 1, wherein said cutout means is an L-shaped cutout means having (i) a vertically diposed cutout means portion for presenting first indicia therethrough, said first indicia being disposed vertically on the lottery ticket with respect to each other when a lottery ticket with indicia thereon is disposed below the template, and (ii) a horizontally disposed cutout means portion for presenting second indicia therethrough, sad second indicia being disposed transversely on the lottery ticket with respect to each other when a lottery ticket with indicia thereon is disposed below the template.

3. The lottery template of claim 2, wherein said vertically disposed cutout means portion is sufficiently high to display a plurality of the first indicia therethrough, and wherein a lottery ticket if disposed under said top surface, is vertically slidably disposable under said top surface, for exposing upon the sliding of the lottery ticket at one time a single tranverse row of second indicia through said horizontally disposed cutout means for comparison with a drawn lottery number entered in to each of said blank space means.

4. The lottery template of claim 1, wherein said blank space means is a first blank space means, the template further comprising a plurality of second blank space means separate from said first blank space means, for the entry into said second blank space means for an initial, quick entry of drawn lottery numbers before the entry thereof into said first blank space means.

* * * * *